US010006270B2

(12) United States Patent
Schwendemann et al.

(10) Patent No.: US 10,006,270 B2
(45) Date of Patent: Jun. 26, 2018

(54) SUBSEA MECHANISM TO CIRCULATE FLUID BETWEEN A RISER AND TUBING STRING

(71) Applicant: Halliburton Energy Services, Inc, Houston, TX (US)

(72) Inventors: Kenneth L. Schwendemann, Flower Mound, TX (US); Donald H. Perkins, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days. days.

(21) Appl. No.: 15/311,239

(22) PCT Filed: Aug. 11, 2014

(86) PCT No.: PCT/US2014/050480

§ 371 (c)(1),
(2) Date: Nov. 15, 2016

(87) PCT Pub. No.: WO2016/024940

PCT Pub. Date: Feb. 18, 2016

(65) Prior Publication Data

US 2017/0074069 A1 Mar. 16, 2017

(51) Int. Cl.

| | |
|---|---|
| ***E21B 34/12*** | (2006.01) |
| ***E21B 17/01*** | (2006.01) |
| ***E21B 34/04*** | (2006.01) |
| ***E21B 21/08*** | (2006.01) |
| *E21B 33/035* | (2006.01) |
| *E21B 33/064* | (2006.01) |
| *E21B 34/00* | (2006.01) |

(52) U.S. Cl.
CPC ..... *E21B 34/12* (2013.01); *E21B 17/01* (2013.01); *E21B 21/08* (2013.01); *E21B 34/045* (2013.01); *E21B 33/035* (2013.01); *E21B 33/064* (2013.01); *E21B 2034/007* (2013.01)

(58) Field of Classification Search
CPC .... E21B 17/01; E21B 2034/007; E21B 21/08; E21B 33/035; E21B 33/064; E21B 34/045; E21B 34/12
See application file for complete search history.

(56) References Cited

U.S. PATENT DOCUMENTS 3,411,576 A * 11/1968 Taylor, Jr. ..... E21B 33/035 166/321
3,724,501 A * 4/1973 Scott ..... E21B 17/01 137/614.11
3,870,101 A * 3/1975 Helmus ..... E21B 29/04 166/322

(Continued)

OTHER PUBLICATIONS

International Search Report and The Written Opinion of the International Search Authority, or the Declaration, dated May 11, 2015, PCT/US2014/050480, 16 pages, ISA/KR.

*Primary Examiner* — James G Sayre

(57) ABSTRACT

A circulation mechanism in a subsea assembly is selectively actuated to allow fluid communication between the riser annulus and tubing string to immediately kill the well using heavy-weight fluid in the riser annulus; perform well control operations by adjusting the weight or other properties of fluid in the tubing string or riser annulus; and/or to circulate the riser of a deep-water well undergoing well testing or intervention.

22 Claims, 5 Drawing Sheets

(56) References Cited

U.S. PATENT DOCUMENTS

| | | | | |
|---|---|---|---|---|
| 4,116,272 | A * | 9/1978 | Barrington | E21B 33/064 166/321 |
| 4,197,879 | A * | 4/1980 | Young | E21B 34/045 137/629 |
| 5,860,478 | A * | 1/1999 | Coutts | E21B 34/045 166/356 |
| 6,026,905 | A * | 2/2000 | Garcia-Soule | E21B 34/045 166/336 |
| 6,109,353 | A * | 8/2000 | Edwards | E21B 17/01 166/344 |
| 6,253,854 | B1 * | 7/2001 | Fenton | E21B 34/045 166/363 |
| 6,419,018 | B1 * | 7/2002 | Naquin | E21B 17/01 166/302 |
| 2005/0241821 | A1 | 11/2005 | Milberger | |
| 2009/0236144 | A1 * | 9/2009 | Todd | E21B 17/01 175/5 |
| 2013/0087388 | A1 | 4/2013 | Veeningen | |
| 2013/0103208 | A1 | 4/2013 | Niemeyer et al. | |
| 2013/0153242 | A1 | 6/2013 | Flight et al. | |
| 2015/0240585 | A1 * | 8/2015 | Mancuso | E21B 33/0355 166/338 |
| 2015/0368998 | A1 * | 12/2015 | Hart | E21B 33/038 166/345 |
| 2016/0201426 | A1 * | 7/2016 | Cohen | E21B 17/10 166/179 |

* cited by examiner

SUBSEA MECHANISM TO CIRCULATE FLUID BETWEEN A RISER AND TUBING STRING

PRIORITY

The present application is a U.S. National Stage patent application of International Patent Application No. PCT/US2014/050480, filed on Aug. 11, 2014, the benefit of which is claimed and the disclosure of which is incorporated herein by reference in its entirety.

FIELD OF THE INVENTION

The present invention relates generally to subsea operations and, more specifically, to a subsea assembly having a circulation mechanism positioned above the blow-out preventer ("BOP") that provides fluid communication between the riser and tubing string.

BACKGROUND

During conventional drilling procedures, it is often desirable to conduct various tests of the wellbore and drill string while the drill string is still in the wellbore. These tests are commonly referred to as drill stem tests ("DST"). To facilitate DST, a subsea test tree ("SSTT") carried by the drill string is positioned within the BOP stack. The SSTT is provided with one or more valves that permit the wellbore to be isolated as desired, for the performance of DST. The SSTT also permits the drill string below the SSTT to be disconnected at the seabed, without interfering with the function of the BOP. In this regard, the SSTT serves as a contingency in the event of an emergency that requires disconnection of the drillstring in the wellbore from the surface, such as in the event of severe weather or malfunction of a dynamic positioning system. As such, the SSTT includes a decoupling mechanism to unlatch the portion of the drill string in the wellbore from the drill string above the wellbore. Thereafter, the surface vessel and riser can decouple from the BOP and move to safety. Finally, the SSTT typically is deployed in conjunction with a fluted hanger disposed to land at the top of the wellbore to at least partially support the lower portion of the drillstring during DST.

During DST and other subsea operations, it is sometimes necessary to "kill" or control the well. This is normally accomplished by circulating/pumping kill weight (heavier) fluids from the surface into the well. This flow can be through the drill string/tubing within the riser and into drill string/tubing in the well. Typically this is circulated through a downhole circulation valve and back up the casing annulus, taking returns through the BOP and choke lines at the seabed. Flow can also be the other direction: flowing down the annulus and up the tubing. This essentially places heavier-weight fluids within the well bore and circulating the lighter fluids into the annulus and returning to the surface.

In other well killing scenarios, the heavier fluid may pumped down to the perforations, displacing fluid into the formation. In this scenario, the fluid can be pumped through the drill string/tubing as above. More typically this is accomplished by utilizing a circulating point in the drill string/tubing to flow heavier fluids from the surface, through the choke and kill lines in the BOP, through the annulus, through the circulating point into the tubing, and into the formation. The circulating point is typically a rupture discoperated safety circulating valve which closes off tubing flow at the device and provides an annulus-to-tubing circulation point below the closure.

A disadvantage to conventional kill and control methods is that they can be time consuming and costly. Operation in deeper water requires considerable volumes of fluid from the surface to be pumped longer distances, which requires more time to place heavier fluids where needed.

In view of the foregoing, there is a need in the art for more efficient approaches to killing and controlling subsea wells.

DESCRIPTION OF ILLUSTRATIVE EMBODIMENTS

Illustrative embodiments and related methodologies of the present invention are described below as they might be employed in a subsea assembly that provides fluid communication between the tubing string and riser annulus. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

As will be described herein, illustrative embodiments of the present disclosure provide a subsea assembly and method to readily control, kill and/or circulate the riser of a deep-water well undergoing well testing or intervention, through the use of well control fluid (e.g., heavy-weight fluid) in the riser. In a generalized embodiment, the riser annulus is filled with a well control fluid after the tubing string is landed inside the BOP. A circulation mechanism is positioned as part of the tubing string, above the SSTT and BOP, to provide selective communication of fluids between the riser annulus and tubing string. When the circulation mechanism is open, fluid is allowed to communicate between the riser and tubing string for a variety of applications such as, for example, well control, fluid circulation, fluid loss, or to kill the well. In one such application, opening of the circulation mechanism allows heavy-weight kill fluid retained in the riser annulus to be quickly dumped into the tubing string at the BOP depth to kill the well. In yet other applications, fluid may be circulated between the tubing string and riser annulus to adjust the weights of the fluids for well control. Another application may be to quickly deliver loss circulation material to the formation. These and other applications of the present disclosure will be apparent to those ordinarily skilled in the art having the benefit of this disclosure.

Figure 1:
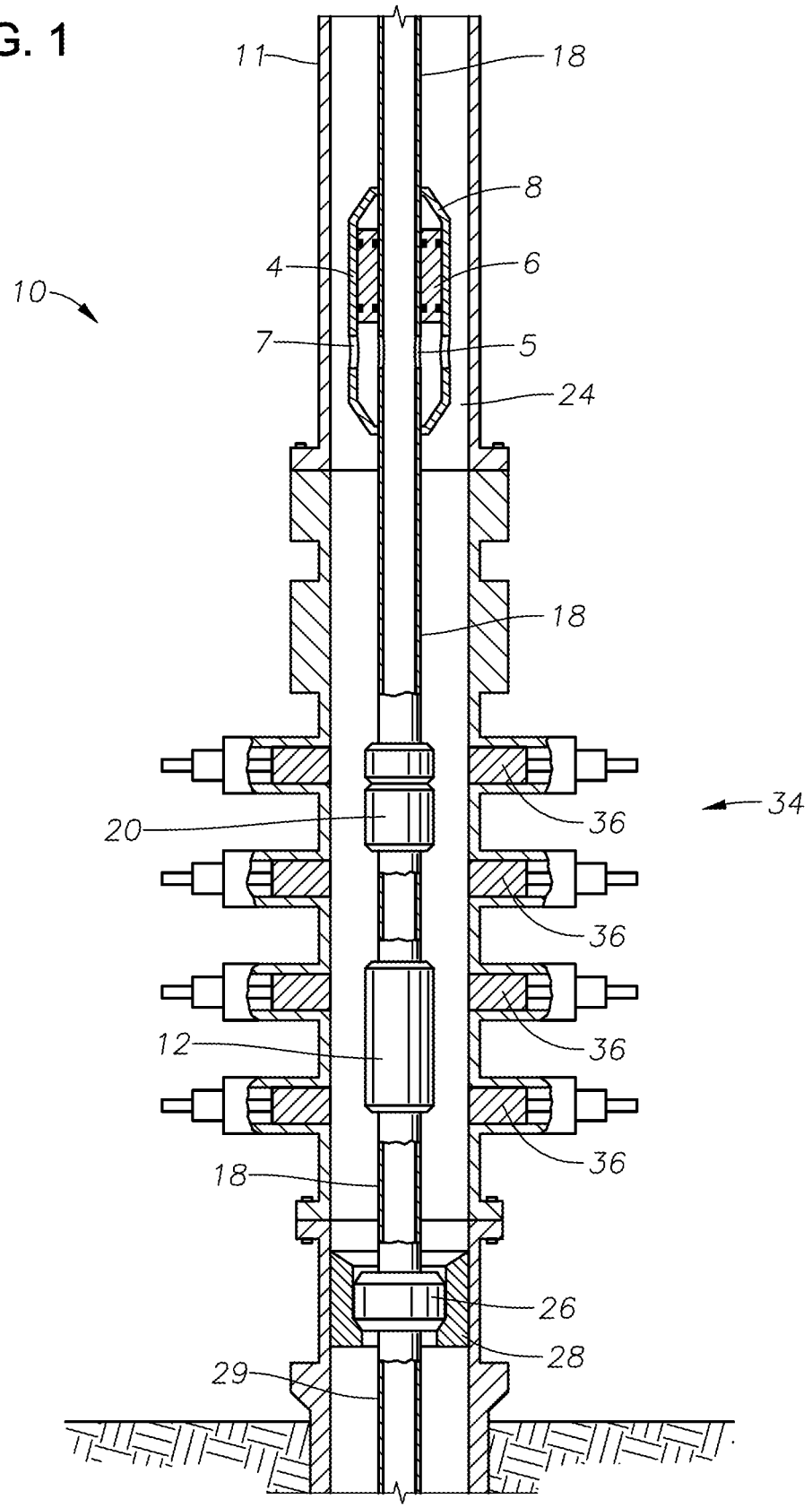
FIG. 1 illustrates an embodiment of a subsea assembly according to an illustrative embodiment of the present disclosure.

FIG. 1 illustrates an illustrative embodiment of a subsea assembly 10, according to illustrative embodiments of the present disclosure. Although not shown, subsea assembly 10 is carried on a tubular string 18 which extends down through a body of water from a surface vessel, via a riser 11 connected to BOP 34 having a series of rams 36. Subsea assembly 10 includes a SSTT 12, as well as a valve/hydraulic latch section 20 that comprises one or more valves and may also include hydraulic mechanisms to operate the valves in order to unlatch the lower portion of tubing string 18 (12 and 18 jointly referred to as "subsea safety system"), as understood in the art. Although not illustrated for the sake of simplicity, SSTT 12 may contain a variety of other desirable components as would be understood by those ordinarily skilled in the art having the benefit of this disclosure. A hanger 26 is positioned along tubing string 18 below SSTT 12. Hanger 26 is landed inside wear bushing 28 to thereby hang off work string 29 (e.g., drill string, tubing string, etc.) extending there-below. Although tubing string 18 is described as tubing, it may also comprise pipe sections.

Subsea assembly 10 also includes a circulation mechanism 8 positioned along tubing string 18 above SSTT 12. Circulation mechanism 8 provides selective communication of fluid between tubing string 18 and the annulus 24 of riser 11. In this illustrative embodiment, circulation mechanism 8 is provided as a sliding sleeve mechanism. However, in alternate embodiments, circulation mechanism may be a variety of valves and/or sleeve-type mechanisms, such as, for example a sleeve valve hydraulically controlled from the surface through control line(s) or a telemetry controlled sleeve valve controlled from the surface with no physical connection.

Still referring to FIG. 1, circulation mechanism 8 is surface controlled and installed in tubing string 18 a short distance above the subsea safety system, above or inside BOP 34. In the illustrated embodiment, circulation mechanism 8 includes a housing 4 in which a sleeve 6 slides and seals along tubing string 18. Sleeve 6 may be actuated between an open and closed position. In FIG. 1, sleeve 6 is shown in the open position. When in the open position, sleeve 6 allows annulus 24 of riser 11 to communicate with the inside of tubing string 18 via one or more ports 5 and 7, located on tubing string 18 and housing 4, respectively. When in the closed position, sleeve 6 is actuated such that it blocks ports 5 and 7, thus preventing fluid communication between annulus 24 and tubing string 18, essentially acting as part of tubing string 18. The surface control of circulation mechanism 8 may be one of many methods such as, for example, direct hydraulic control via single or dual control lines, electrical control, etc.

Figure 2A:
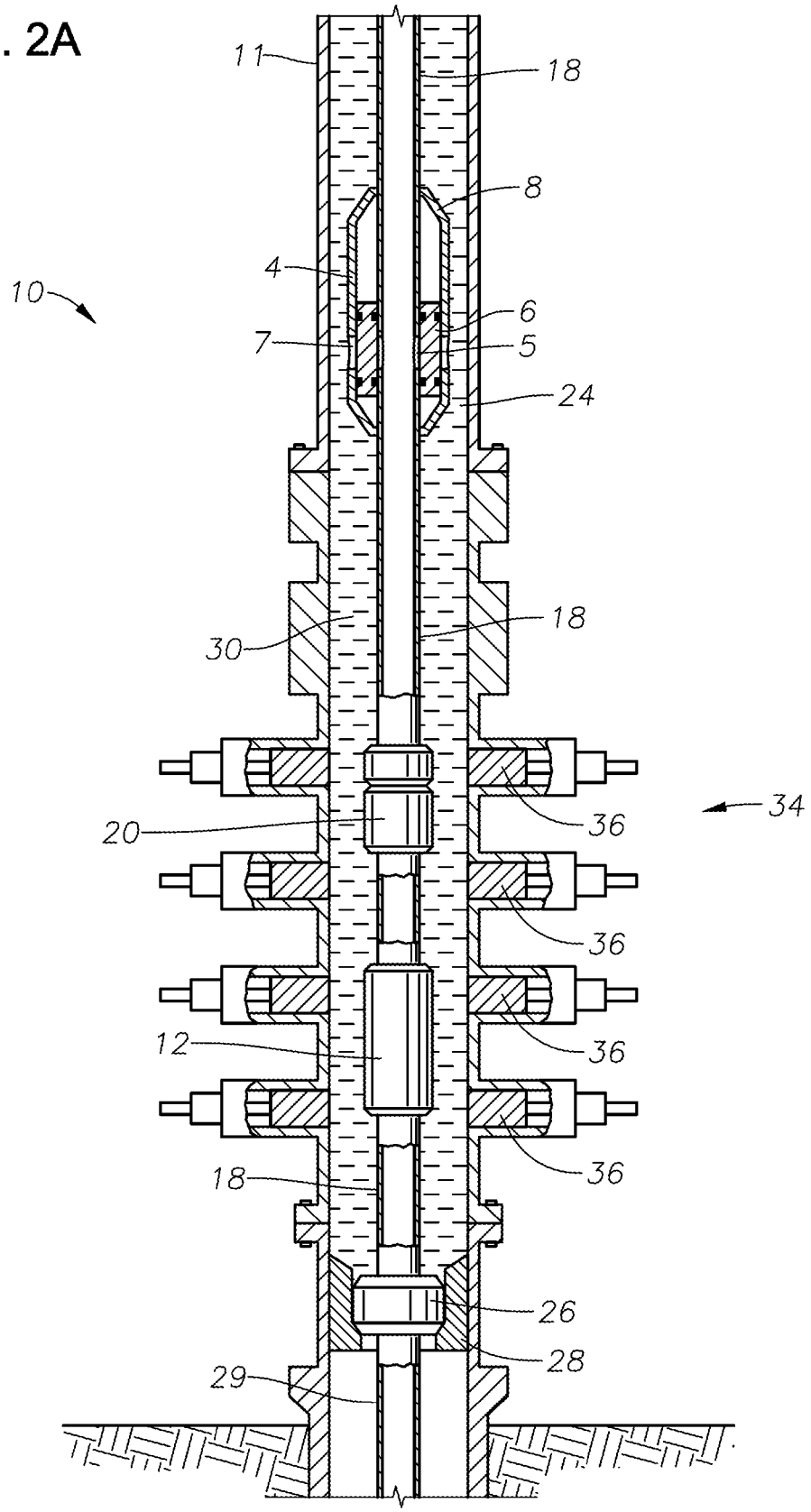
FIGS. 2A-2C illustrate various alternative methods performed using the subsea assembly of FIG. 1.
Figure 2B:
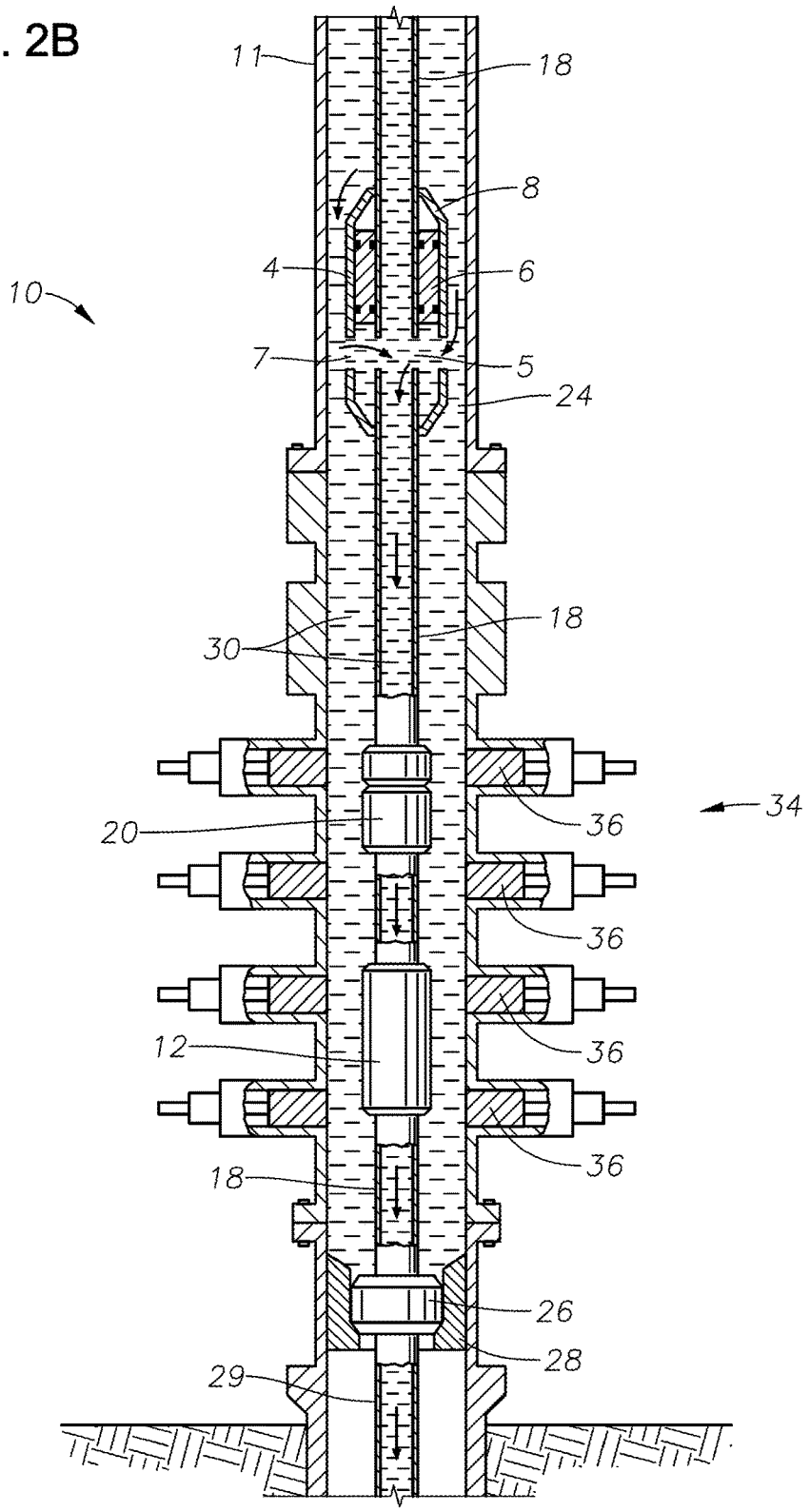

With reference to FIGS. 2A-2B, an illustrative method of the present disclosure will now be described. FIG. 2A illustrates subsea assembly 10 in which riser annulus 24 has been filled with a heavy-weight fluid 30 (also referred to herein as "riser fluid"). Fluid weight and properties are selected such that their densities and effective hydrostatic pressure at the formation exceed formation pressure, but are selected to avoid formation damage. As previously described, one illustrative application of the present disclosure is to kill a well quickly. In such applications, once tubing string 18 is landed inside wear bushing 28, circulation mechanism 8 is actuated into the closed position (if not already in the closed position) and riser 11 is filled with heavy-weight kill fluid 30. As a result, heavy-weight kill fluid 30 is immediately available when needed. The weight of heavy-weight kill fluid 30 will depend on the specific well conditions such as, for example, water depth, expected reservoir pressure, and the hydrostatic pressure of the well.

When it is desired to kill the well in an emergency situation such as, for example, an unexpected over-pressure during drill stem testing operations or a leaking packer and/or BOP, circulation mechanism 8 is actuated into the open position. Control of circulation mechanism 8 may be conducted using a control system located at the surface or some other remote location. FIG. 2B shows circulation device 8 in the open position. Once opened, a fluid communication path from riser annulus 24 to tubing string 18 is established, thereby allowing heavy-weight kill fluid 30 to enter work string 29 above the subsea safety system (SSTT 12/latch 20). Thereafter, by opening SSTT 12 (if it is not already open), heavy-weight kill fluid 30 is allowed to flow immediately into tubing string 18. Because of the much larger volume of riser annulus 24 compared to the tubing volume, heavy-weight kill fluid 30 will fill a significant length of tubing string 18, if not completely to the formation depth to thereby kill or control the well.

Figure 2C:
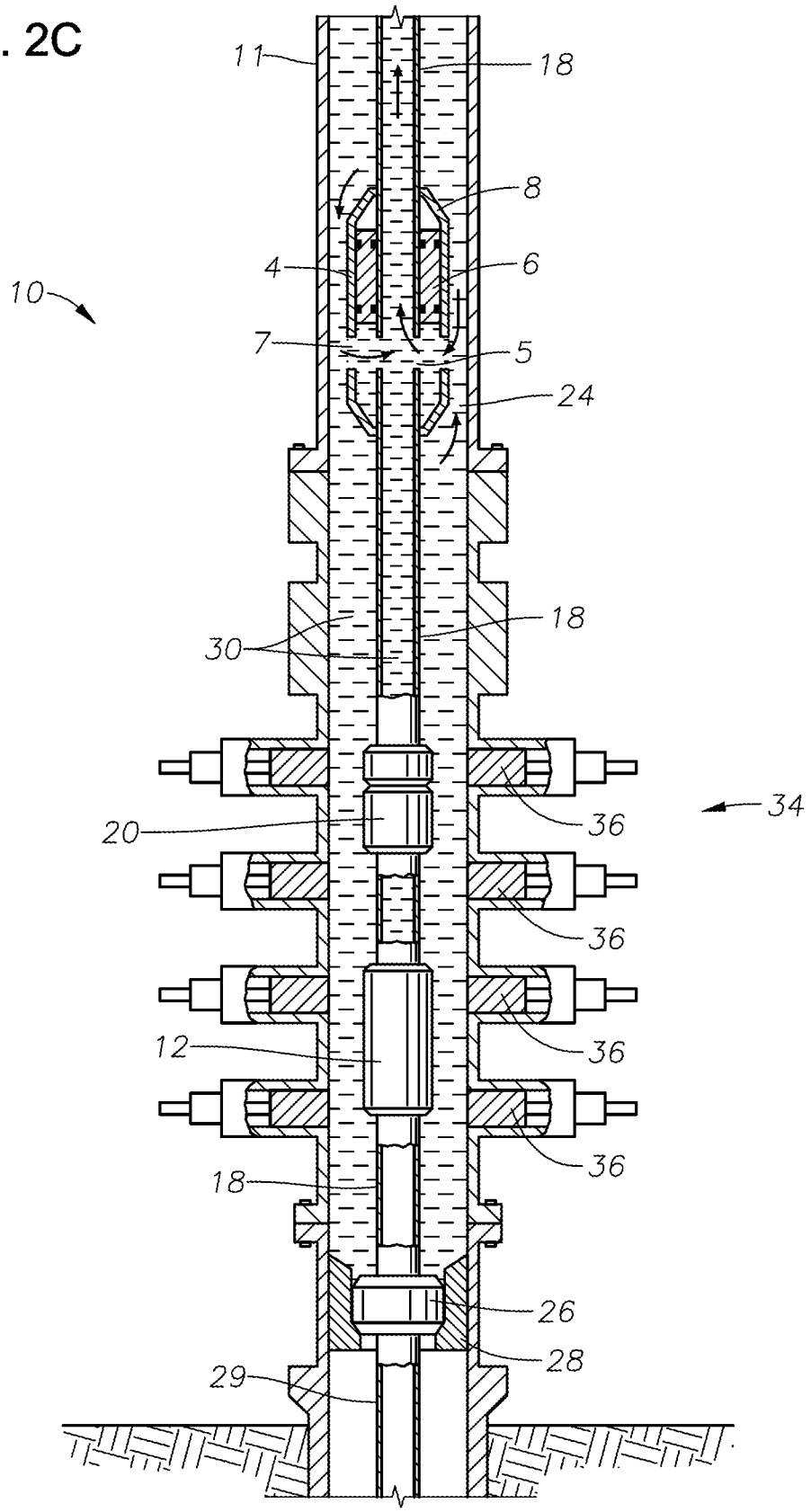

FIG. 2C illustrates an alternative method of the present disclosure whereby a well is killed after removing gas or lighter fluid from tubing string 18. After riser annulus 24 has been filled with heavy-weight fluid 30 as shown in FIG. 2A, SSTT 12 is closed to prevent fluid communication below the subsea safety system. With reference to FIG. 2C, in this method tubing string 18 is filled with gas or some other light weight fluid (i.e., lighter than heavy-weight kill fluid 30 in riser annulus 24. Thereafter, circulation mechanism 8 is opened to allow fluid 30 to flow into tubing string 18. Since SSTT 12 is still closed, fluid 30 will be forced up tubing string 18 as returns, thereby removing the gas or other light weight fluid from tubing string 18. As a result, tubing string 18 is filled with kill fluid before the well is opened. Thereafter, SSTT 12 may be opened and heavy-weight kill fluid 30 allowed to flow downhole to thereby kill the well.

In an alternative method to that illustrated in FIG. 2C, after SSTT 12 is closed and circulation mechanism 8 opened, the gas or lighter weight fluid may be out of tubing string 18 and into riser annulus 24. Thereafter, circulation mechanism 8 may be closed and SSTT opened, to thereby allow production of well fluids up tubing string 18.

Figure 3:
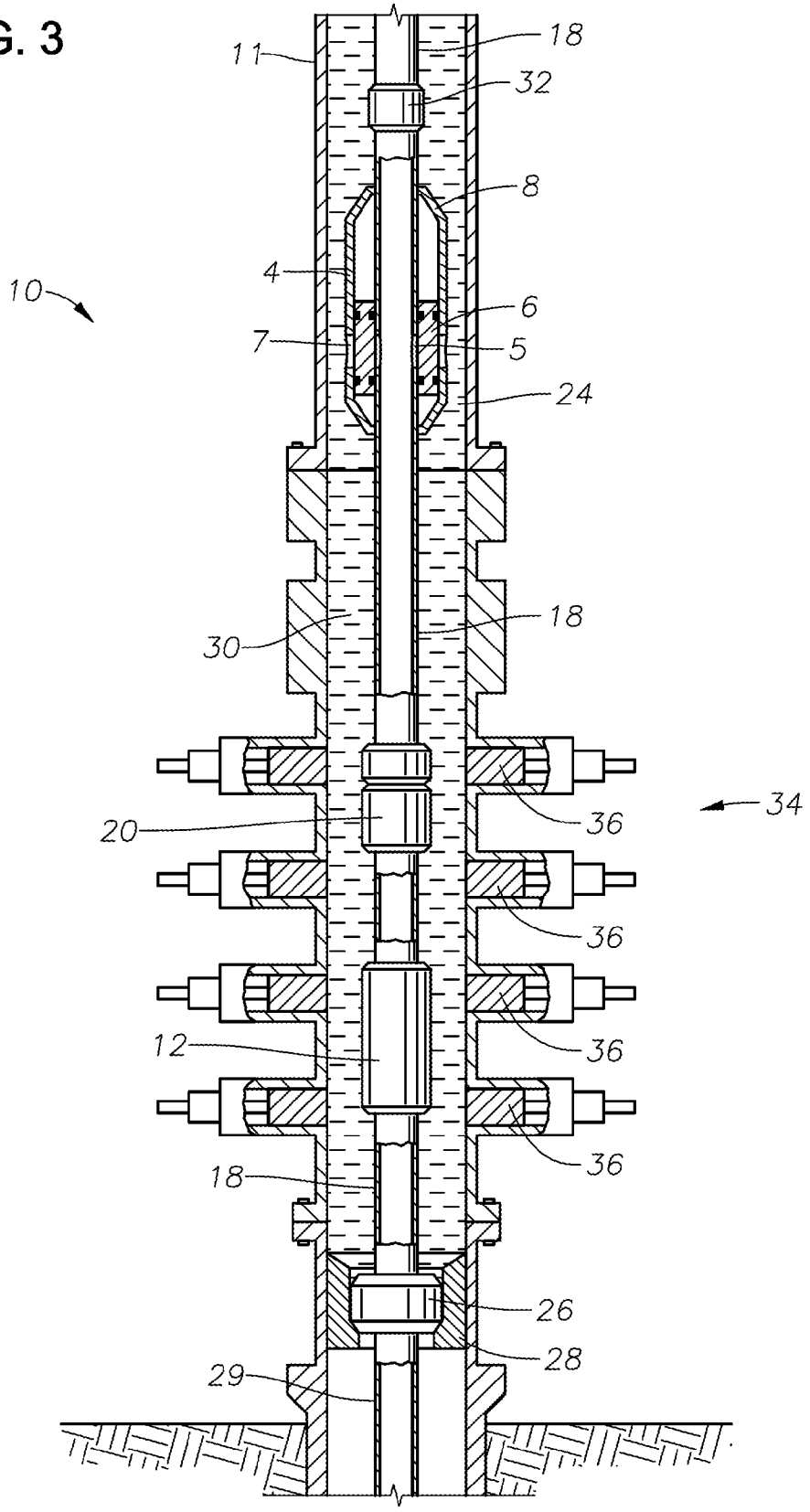
FIG. 3 illustrates an alternative embodiment of a subsea assembly according to an illustrative embodiment of the present disclosure.

FIG. 3 illustrates an alternative embodiment of subsea assembly 10 in which a tubing closure mechanism 32 (e.g., safety valve) is positioned along tubing string 18 above circulation mechanism 8. In this illustrative embodiment, tubing closure mechanism 32 prevents the flow of fluid uphole and may be a variety of valves, such as, for example, surface-controlled ball valves, retainer valves, Omni circulating valves, etc. However, in alternative embodiments, tubing closure mechanism 32 may selectively prevent fluid flow in both the uphole and downhole directions. Nevertheless, in this method, the well may be producing gas. When killing of the well is desired, tubing closure mechanism 32 will be closed to prevent uphole flow of gas in tubing string 18. During this time, circulation mechanism 8 is closed. However, once tubing closure mechanism 32 is closed, circulation mechanism 8 is opened, thereby allowing the flow of heavy-weight kill fluid 30 into tubing string 18 and down past SSTT 12. This provides controlled flow of the kill fluids directly into well rather than needing to fill the volume of the tubing above the circulation point. This will speed up killing operation and reduce the kill volume required. Once a sufficient volume of heavy-weight kill fluid 30 has been circulated into tubing string 18 to kill the well, SSTT 12 is closed.

In an alternate embodiment, circulation mechanism 8 may be positioned above tubing closure mechanism 32. In yet another embodiment, circulation mechanism 8 is positioned above tubing closure mechanism 32, while a second circulation mechanism is positioned below tubing closure mechanism 32. The latter embodiment provides further benefits in dumping or pumping riser fluid into the lower tubing (with the tubing is closed above via closure mechanism 32) plus the ability to circulate/change fluid in the riser and tubing above closure mechanism 32 while being closed to the well below via closure mechanism 32.

In addition to the applications described herein, circulation mechanism 8 may be utilized to perform other well control or well testing operations. For example, allowing communication of fluid between tubing string 18 and riser annulus 24 may be used to selectively adjust the weight of the riser fluid or to adjust the weight of fluid in tubing string 18. Such adjustments are achieved by moving certain volumes of fluid into or out of tubing string 18/riser annulus 24.

Accordingly, the illustrative embodiments of the present disclosure described provide a variety of advantages. First, for example, kill fluid is immediately available in emergency situations. Second, unlike prior art methods, it is no longer necessary to unlatch the subsea safety system to circulate above the SSTT. Third, more flexibility in managing fluid weight or types in the riser/tubing section of the well is provided, which is even more critical in ultra-deep water environments. As a result, safer underbalanced well testing and intervention operations are attained. Moreover, costly rig time is saved with the ability to quickly adjust to changing or unexpected formation conditions with the capability to adjust fluid weights in the riser/tubing section without affecting the well, even during "idle" times such as during a well testing buildup.

Embodiments described herein further relate to any one or more of the following paragraphs:

1. A subsea assembly, comprising a tubing string extending within a riser, the riser having riser fluid therein and being connected to a blow-out preventer ("BOP") positioned at a sea floor; a subsea test tree ("SSTT") positioned along the tubing string; and a circulation mechanism positioned along the tubing string above the SSTT to allow selective communication of fluid between the tubing string and riser.

2. A subsea assembly as defined in paragraph 1, wherein the circulation mechanism comprises: a port positioned along the tubing string; and a sliding sleeve positioned around the tubing string to move between an open and closed position in relation to the port, the open position allowing fluid to communicate between the tubing string and riser, the closed position preventing fluid from communicating between the tubing string and riser.

3. A subsea assembly as defined in paragraphs 1 or 2, wherein the circulation mechanism is surface-controlled.

4. A subsea assembly as defined in any of paragraphs 1-3, wherein the circulation mechanism is positioned above the BOP.

5. A subsea assembly as defined in any of paragraphs 1-4, wherein the riser fluid is a heavy-weight kill fluid.

6. A subsea assembly as defined in any of paragraphs 1-5, further comprising a tubing closure mechanism positioned as part of the tubing string, wherein the circulation mechanism is positioned above or below the tubing closure mechanism.

7. A subsea assembly as defined in any of paragraphs 1-6, further comprising a tubing closure mechanism positioned as part of the tubing string, wherein the circulation mechanism is positioned above the tubing closure mechanism and a second circulation mechanism is positioned below the tubing closure mechanism.

8. A subsea assembly as defined in any of paragraphs 1-7, wherein the tubing closure mechanism is a ball valve, retainer valve or circulation valve.

9. A method using a subsea assembly, the method comprising: deploying a tubing string into a riser, the riser being connected to a blow-out preventer ("BOP") positioned at a sea floor above a well; filling the riser with riser fluid; and actuating a circulation mechanism to allow selective communication of fluid between the riser and the tubing string, the circulation mechanism being positioned as part of the tubing string above a subsea test tree ("SSTT").

10. A method as defined in paragraph 9, wherein actuating the circulation mechanism comprises: opening a sliding sleeve to allow the fluid to communicate between the riser and tubing string; or closing a sliding sleeve to prevent the fluid from communicating between the riser and tubing string.

11. A method as defined in paragraphs 9 or 10, wherein: filing the riser with riser fluid comprises filling the riser with a heavy-weight kill fluid; and actuating the circulation mechanism comprises opening the circulation mechanism to allow the heavy-weight kill fluid to flow from the riser into the tubing string, the method further comprising killing the well using the heavy-weight kill fluid.

12. A method as defined in any of paragraphs 9-11, wherein: the SSTT is closed; filling the riser with riser fluid comprises filling the riser with a heavy-weight kill fluid; and actuating the circulation mechanism comprises opening the circulation mechanism to allow the heavy-weight kill fluid to flow from the riser into the tubing string, thereby causing returns to flow up through the tubing string, the method further comprising: opening the SSTT; and killing the well using the heavy-weight kill fluid.

13. A method as defined in any of paragraphs 9-12, wherein, before the SSTT is closed, the tubing string is filled with gas or a fluid lighter than the heavy-weight kill fluid.

14. A method as defined in any of paragraphs 9-13, wherein: the SSTT is closed; and actuating the circulation mechanism comprises opening the circulation mechanism the method further comprising: pumping gas down the tubing string and out into the riser; closing the circulation mechanism; and opening the SSTT to allow production of well fluids.

15. A method as defined in any of paragraphs 9-14, further comprising: preventing fluid flow up the tubing string using a tubing closure mechanism positioned above the circulation mechanism, wherein actuating the circulation mechanism comprises opening the circulation mechanism to allow the riser fluid to flow from the riser into the tubing string, the riser fluid being a heavy-weight kill fluid; killing the well using the heavy-weight kill fluid; and closing the SSTT.

16. A method as defined in any of paragraphs 9-15, wherein actuating the circulation mechanism comprises opening the circulation mechanism to: adjust a weight of the riser fluid; or adjust a weight of fluid in the tubing string.

17. A method using a subsea assembly, the method comprising: deploying a tubing string into a riser, the riser having riser fluid therein and being connected to a blow-out preventer ("BOP") positioned at a sea floor above a well; and selectively communicating fluid between the riser and the tubing string.

18. A method as defined in paragraph 17, wherein selectively communicating the fluid comprises: flowing the riser fluid to flow from the riser and into the tubing string; or flowing fluid within the tubing string from the tubing string and into the riser.

19. A method as defined in any of paragraphs 17 or 18, wherein selectively communicating the fluid comprises: flowing the riser fluid from the riser and into the tubing string; and killing the well using the riser fluid.

20. A method as defined in any of paragraphs 17-19, further comprising: closing a subsea test tree ("SSTT") positioned along the tubing string; flowing the riser fluid from the riser, into the tubing string, and up the tubing string; opening the SSTT; and killing the well with the riser fluid.

21. A method as defined in any of paragraphs 17-20, further comprising: closing a subsea test tree ("SSTT"); pumping fluid down the tubing string and out into the riser via a port positioned along the tubing string; closing the port; and opening the SSTT to allow production of well fluids.

22. A method as defined in any of paragraphs 17-21, further comprising: preventing fluid flow up the tubing string; flowing the riser fluid from the riser and into the tubing string; killing the well using the riser fluid; and closing a subsea test tree ("SSTT").

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. For example, instead of filling the riser with heavy-weight fluid immediately after landing, the riser may be filled at some other time when it is desired to kill or control the well. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A subsea assembly, comprising:

a riser extending through a body of water and connected to a blow-out preventer ("BOP") positioned at a sea floor;

a tubing string extending within the riser such that a riser annulus is defined between the tubing string and the riser;

a subsea test tree ("SSTT") positioned along the tubing string;

a work string extending below the sea floor to a formation depth and defining a tubing volume therein;

a riser fluid disposed in the riser annulus, the riser fluid in the riser annulus having a fluid volume at least equal to the tubing volume; and a circulation mechanism positioned along the tubing string above the SSTT to allow selective communication of the riser fluid between the tubing string and the riser annulus through a port defined through the tubing string.

2. A subsea assembly as defined in claim 1, wherein the circulation mechanism comprises:

a sliding sleeve positioned around the tubing string to move between an open and closed position in relation to the port, the open position allowing fluid to communicate between the tubing string and the riser annulus, the closed position preventing fluid from communicating between the tubing string and the riser annulus.

3. A subsea assembly as defined in claim 1, wherein the circulation mechanism is surface-controlled.

4. A subsea assembly as defined in claim 1, wherein the circulation mechanism is positioned above the BOP.

5. A subsea assembly as defined in claim 1, wherein the riser fluid is a heavy-weight kill fluid.

6. A subsea assembly as defined in claim 1, further comprising a tubing closure mechanism positioned as part of the tubing string, wherein the circulation mechanism is positioned above or below the tubing closure mechanism.

7. A subsea assembly as defined in claim 6, wherein the tubing closure mechanism is a ball valve, retainer valve or circulation valve.

8. A subsea assembly as defined in claim 1, further comprising a tubing closure mechanism positioned as part of the tubing string, wherein the circulation mechanism is positioned above the tubing closure mechanism and a second circulation mechanism is positioned below the tubing closure mechanism.

9. A method of using a subsea assembly, the method comprising:

deploying a tubing string into a riser to define a riser annulus between the tubing string and the riser, the riser being connected to a blow-out preventer ("BOP") positioned at a sea floor above a well;

filling the riser annulus with a sufficient volume of a riser fluid to fill a tubing volume of a work string extending to a formation depth into the well below the sea floor;

actuating a circulation mechanism to allow communication of the riser fluid between the riser annulus and the tubing string, the circulation mechanism being positioned as part of the tubing string above a subsea test tree ("SSTT"); and filling the tubing volume with the riser fluid by flowing the riser fluid from the riser annulus into the work string through the tubing string.

10. A method as defined in claim 9, wherein actuating the circulation mechanism comprises:

opening a sliding sleeve to allow the riser fluid to communicate between the riser annulus and the tubing string; or closing the sliding sleeve to prevent the riser fluid from communicating between the riser annulus and the tubing string.

11. A method as defined in claim 9, wherein:

filing the riser annulus with riser fluid comprises filling the riser annulus with a heavy-weight kill fluid; and actuating the circulation mechanism comprises opening the circulation mechanism to allow the heavy-weight kill fluid to flow from the riser annulus into the tubing string, the method further comprising killing the well using the heavy-weight kill fluid.

12. A method as defined in claim 9, wherein:

the SSTT is closed;

filling the riser annulus with riser fluid comprises filling the riser annulus with a heavy-weight kill fluid; and actuating the circulation mechanism comprises opening the circulation mechanism to allow the heavy-weight kill fluid to flow from the riser annulus into the tubing string, thereby causing returns to flow up through the tubing string, the method further comprising:

opening the SSTT; and killing the well using the heavy-weight kill fluid.

13. A method as defined in claim 12, wherein, before the SSTT is closed, the tubing string is filled with gas or a fluid lighter than the heavy-weight kill fluid.

14. A method as defined in claim 9, wherein:

the SSTT is closed; and actuating the circulation mechanism comprises opening the circulation mechanism, the method further comprising:

pumping gas down the tubing string and out into the riser annulus;

closing the circulation mechanism; and opening the SSTT to allow production of well fluids.

15. A method as defined in claim 9, further comprising:

preventing fluid flow up the tubing string using a tubing closure mechanism positioned above the circulation mechanism, wherein actuating the circulation mechanism comprises opening the circulation mechanism to allow the riser fluid to flow from the riser annulus into the tubing string, the riser fluid being a heavy-weight kill fluid;

killing the well using the heavy-weight kill fluid; and closing the SSTT.

16. A method as defined in claim 9, wherein actuating the circulation mechanism comprises opening the circulation mechanism to:

adjust a weight of the riser fluid; or adjust a weight of fluid in the tubing string.

17. A method of using a subsea assembly, the method comprising:

deploying a tubing string into a riser, thereby forming a riser annulus between the riser and the tubing string, the riser annulus having a volume of riser fluid therein, the riser being connected to a blow-out preventer ("BOP") positioned at a sea floor above a well; and selectively communicating the volume of riser fluid from the riser annulus and into the tubing string to thereby fill a tubing volume of a work string extending to a formation depth into the well below the sea floor.

18. A method as defined in claim 17, wherein selectively communicating the fluid comprises:

flowing the riser fluid to flow from the riser annulus and into the tubing string; or flowing fluid within the tubing string from the tubing string and into the riser annulus.

19. A method as defined in claim 17, wherein selectively communicating the fluid comprises:

killing the well using the riser fluid.

20. A method as defined in claim 17, further comprising:

closing a subsea test tree ("SSTT") positioned along the tubing string;

flowing the riser fluid up the tubing string;

opening the SSTT; and killing the well with the riser fluid.

21. A method as defined in claim 17, further comprising:

closing a subsea test tree ("SSTT");

pumping fluid down the tubing string and out into the riser annulus via a port positioned along the tubing string;

closing the port; and opening the SSTT to allow production of well fluids.

22. A method as defined in claim 17, further comprising:

preventing fluid flow up the tubing string;

killing the well using the riser fluid; and closing a subsea test tree ("SSTT").

* * * * *